US005695356A

United States Patent [19]

Swanson

[11] Patent Number: 5,695,356

[45] **Date of Patent: *Dec. 9, 1997**

[54] ELECTRICAL CABLE APPARATUS

[76] Inventor: Carl E. Swanson, 707 E. South St., Corry, Pa. 16407

[ * ] Notice: The term of this patent shall not extend beyond the expiration date of Pat. No. 5,514,004.

[21] Appl. No.: 726,310

[22] Filed: Oct. 2, 1996

[51] Int. Cl.[6] ..... H01R 13/62

[52] U.S. Cl. ..... 439/369

[58] Field of Search ..... 439/360, 361, 439/362, 364, 365, 366, 368, 369, 370

[56] References Cited

U.S. PATENT DOCUMENTS

| | | | |
|---|---|---|---|
| 2,266,560 | 12/1941 | Mansfield . | |
| 2,761,109 | 8/1956 | Hacker . | |
| 2,984,938 | 5/1961 | Crawford . | |
| 3,781,761 | 12/1973 | Harwood . | |
| 3,922,055 | 11/1975 | McGregor . | |
| 4,504,106 | 3/1985 | Fechter . | |
| 5,423,693 | 6/1995 | Light | 439/369 |
| 5,514,004 | 5/1996 | Swanson . | |

FOREIGN PATENT DOCUMENTS

| | | |
|---|---|---|
| 0142383 | 7/1935 | Germany . |

*Primary Examiner*—Khiem Nguyen
*Assistant Examiner*—Yong Ki-Kim
*Attorney, Agent, or Firm*—Craig G. Cochenour

[57] ABSTRACT

An combination of a male connector electrical contacting device, a female connector electrical contacting device and an apparatus is disclosed for enabling the secure engagement of a first electrical cable of the male connector electrical contacting device to a second electrical cable of the female connector electrical contacting device. The apparatus includes a rigid body having a center region and a first end region and a second end region positioned at opposite ends of the center region. Each end region of the rigid body defines (a) a leg having a proximal end and a distal end relative to the center region, wherein the proximal end of the leg forms about a ninety degree turn relative to the center region, and (b) a substantially S shaped structure having a middle section, proximal hook section and distal hook section in relationship to the distal end of the leg. The middle sections of the S shaped structures are disposed between the proximal hook sections and the distal hook sections of the S shaped structures. The distal ends of the legs form about a ninety degree turn relative to the proximal hook sections of the S shaped structures.

8 Claims, 2 Drawing Sheets

ELECTRICAL CABLE APPARATUS

BACKGROUND OF THE INVENTION

1. Field Of The Invention

This invention relates to an apparatus for enabling the secure engagement of a male connector electrical contacting device having a first electrical cable to a female connector electrical contacting device having a second electrical cable.

2. Brief Description Of The Background Art

A secure engagement of electrical contacting devices having electrical cables is necessary for the successful employment of power equipment requiring electricity for operation. For example, an extension electrical cable is often required to be joined to the electrical cable of the power equipment to enable electrical power from an electrical power source to be supplied to the power equipment when it is desirable to employ the power equipment at a site that is remote from the electrical power source and at a distance that exceeds the length of the electrical cable of the power equipment. Often during the use of power equipment, the power equipment is operated and moved in such a manner that the extension electrical cable becomes unintentionally disengaged from the electrical cable of the power equipment. This unintentional disengagement is caused, such as for example, by vibration or stress applied relative to the male connector electrical contacting device (i.e. a plug) of the electrical cable of the power equipment and the female connector electrical contacting device (i.e. a socket) of the extension electrical cable. For example, the use of power equipment such as an outdoor electric hedge trimmer may require that a female connector electrical contacting device of an extension electrical cable be engaged to a male connector electrical contacting device of the electrical cable that is securely attached to the hedge trimmer. Successful operation of the hedge trimmer requires that the extension electrical cable be pulled over the rough and/or uneven surfaces of the ground or a foundation of a building causing accidental and unintentional disengagement of the female connector electrical contacting device of the extension electrical cable from the male connector electrical contacting device of the electrical cable of the hedge trimmer. It will be appreciated by those skilled in the art that the apparatus of the present invention may be used indoors as well as outdoors for ensuring the secure engagement of a male electrical contacting device to a female electrical contacting device.

A number of patents disclose apparatuses for securing together electrical contacting devices of electrical cables. It will be understood by those skilled in the art that generally these background art devices attempt to securely fix together a plug (i.e. a male connector electrical contacting device) on one end of an extension electrical cable or an electrical cable of a power equipment and a socket (i.e. a female connector electrical contacting device) on one end of an extension electrical cable. However, none of the background art teach or suggest the apparatus of the present invention.

U.S. Pat. No. 5,514,004 (Swanson) discloses a combination of a male connector electrical contacting device, a female connector electrical contacting device and an apparatus. This patent states that the apparatus comprise a rigid body having a center region, a first end region and a second end region wherein the first end region are at opposite ends of the center region. This patent discloses that each end region defines an S shaped structure having a middle section, a proximal hook section and a distal hook section. This patent discloses that the proximal hook and middle sections of the S shaped structures are positioned with regard to the longitudinal axis of the center region of the rigid body in a same longitudinal plane as the center region of the rigid body. Further, this patent states that the distal hook section of the S shaped structure of the first end region and the distal hook section of the S shaped structure of the second end region are positioned on opposite sides of the longitudinal plane. In contrast to U.S. Pat. No. 5,514,004 (Swanson), the instant invention, as described more fully herein, sets forth a combination of a male connector electrical contacting device, a female connector electrical contacting device, and an apparatus, wherein the apparatus comprises a rigid body having a center region, a first end region and a second end region. The instant apparatus includes wherein the first end region and the second end region each define a leg and a S shaped structure, and wherein each leg forms about a ninety degree turn relative to the center region and about a ninety degree turn relative to the S shaped structure. Further, in contrast to U.S. Pat. No. 5,514,004 (Swanson), the instant invention, as described more fully herein, sets forth that the distal hook sections of the S shaped structures of the first and the second end regions are positioned on the same side of the longitudinal plane relative to the longitudinal axis of the center region. Thus, it will be understood by those skilled in the art that U.S. Pat. No. 5,514,004 (Swanson) does not teach or suggest the instant invention as described herein and as recited in the attached claims.

U.S. Pat. No. 3,922,055 (McGregor) discloses a device for securing a first electrical cable to a second electrical cable. This patent states that the device is an elongated rigid steel rod-like member having a mid-section region with first and second opposite end regions, wherein the end regions each define a coil-like structure with several turns for holding the electrical cables. However, as shown in the drawings of this patent, each electrical cable lies in a straight line when passing through the turns of the coils of the respective end regions, and therefore, the electrical cables tend to slip through the coils when pulled. This patent states that a manually operable clamp is pivotally secured to the mid-section region to detachably engage the engaged electrical connectors and for locking the same together.

U.S. Pat. No. 4,504,106 (Fechter) discloses an apparatus for securing together electrical cords comprising a hoop shaped body wherein electrical contacting devices are received, and two S shaped members connected to the body on opposite sides thereof so that the electrical contacting devices are between the members, and wherein each of the S shaped members have a center bar extending perpendicular to the longitudinal direction of the cords and two hook portions facing in opposite directions connected to the bar on opposite sides thereof, wherein each of the S shaped members are shaped to tightly receive a loop of one of the cords. This patent states that the center bar is connected to the hoop-shaped body by welding or soldering.

In spite of this background art, there remains a very real and substantial need for an apparatus for enabling the secure engagement of one end of a first electrical cable to an end of a second electrical cable for improving the ease of operation of equipment requiring electrical power.

SUMMARY OF THE INVENTION

The present invention has met the above-described need. The apparatus of the present invention provides an efficient and economical approach for substantially reducing and/or eliminating the undesired problems associated with accidental and/or unintentional disengagement of one electrical cable from another electrical cable.

This invention provides for a combination male connector electrical contacting device, a female connector electrical contacting device and an apparatus for securing the engagement of a first electrical cable of the male connector electrical contacting device to a second electrical cable of the female connector electrical contacting device, wherein the apparatus comprises a rigid body having a center region, a first end region and a second end region. The first end region and the second end region of the rigid body of the apparatus are at opposite ends of the center region of the rigid body. The first end region and the second end region each define (a) a leg having a proximal end and a distal end relative to the center region of the rigid body, wherein the proximal end of the leg forms about a ninety degree turn relative to the center region of the rigid body, and (b) a substantially S shaped structure. The S shaped structure of each end region of the rigid body has a middle section and a proximal hook section and a distal hook section relative to the leg of the rigid body. The middle section of the S shaped structure is disposed between the proximal hook section and the distal hook section of the S shaped structure. The proximal hook section of the S shaped structure faces in an opposite direction relative to the distal hook section of the S shaped structure. The distal end of each leg forms about a ninety degree turn relative to the proximal hook section of the S shaped structure. Each of the S shaped structures define a single turn. The center region of the rigid body and the legs of the rigid body are positioned with regard to the longitudinal axis of the center region of the rigid body, in a same longitudinal plane as the center region of the rigid body. The proximal hook sections and the middle sections of the S shaped structures are positioned in an outward extending direction in relationship to the legs and the center region of the rigid body in such a manner that the proximal hook sections and the middle sections of the S shaped structures lie outside the longitudinal plane, and wherein the S shaped structures are positioned on the same side of the longitudinal plane. The male connector electrical contacting device and the female connector electrical contacting device are disposed in juxtaposition to the center region of the rigid body and are capable of being intentionally manually engaged and disengaged adjacent to the center region of the rigid body. The first electrical cable is placed removably in the single turn of the S shaped structure of the first end region of the rigid body of the apparatus such that the first electrical cable is wound through the single turn of the S shaped structure of the first end region. The second electrical cable is placed removably in the single turn of the S shaped structure of the second end region of the rigid body of the apparatus such that the second electrical cable is wound through the single turn of the S shaped structure of the second end region.

In another embodiment of this invention, the combination includes wherein the first electrical cable passes over the proximal hook section of the S shaped structure of the first end region of the apparatus, under the middle section of the S shaped structure of the first end region, and over the distal hook section of the S shaped structure of the first end region, and wherein the second electrical cable passes over the proximal hook section of the S shaped structure of the second end region of the apparatus, under the middle section of the S shaped structure of the second end region, and over the distal hook section of the S shaped structure of the second end region.

In another embodiment of this invention, the combination further includes wherein a portion of the distal hook section of the S shaped structure of the first end region of the rigid body of the apparatus and a portion of the distal hook section of the S shaped structure of the second end region of the rigid body of the apparatus are positioned in relationship to the legs and the center region of the rigid body of the apparatus in such a manner that the portions of the distal hook sections of the S shaped structures lie in the same longitudinal plane as the legs and the center region of the rigid body of the apparatus.

Another embodiment of the combination of this invention includes wherein the legs of the rigid body of the apparatus are in a pendicular arrangement with regard to the center region of the rigid body.

In a preferred embodiment of this invention, the combination includes wherein the proximal hook sections of the S shaped structures are positioned in relationship to the horizontal axis of the middle sections of the S shaped structures in such a manner that the proximal hook sections of the S shaped structures lie in the same horizontal plane as the middle sections of the S shaped structures. In a more preferred embodiment of this invention, the combination includes wherein a portion of the distal hook sections of the S shaped structures are positioned in relationship to the proximal hook sections and middle sections of the S shaped structures in such a manner that the portion of the distal hook sections of the S shaped structures lie in the same horizontal plane as the proximal hook sections and the middle sections of the S shaped structures.

The combination of the present invention will be more fully understood from the following descriptions of the invention, and the drawings and the claims appended hereto.

DETAILED DESCRIPTION OF THE INVENTION

The present invention provides for a combination of a male connector electrical contacting device, a female connector electrical contacting device and an apparatus for enabling the secure engagement of a first electrical cable of the male connector electrical contacting device to a second electrical cable of the female connector electrical contacting device.

Figure 1:
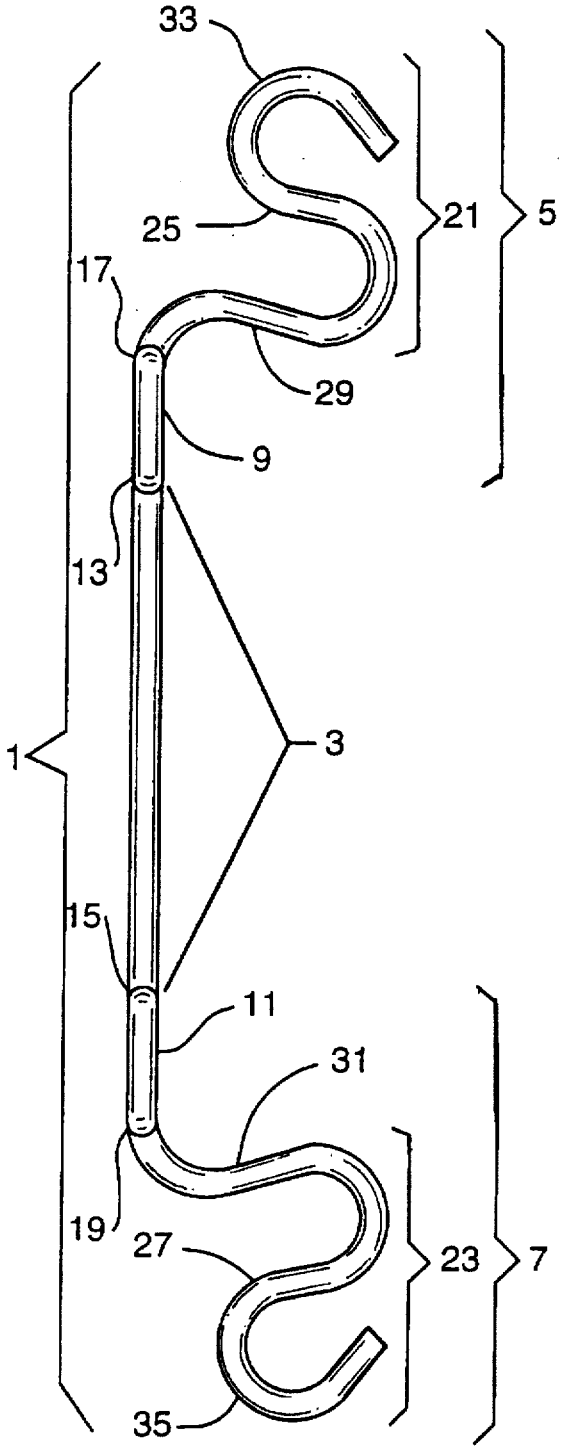
FIG. 1 is a top plan view of a form of the apparatus of the combination of the present invention.
Figure 2:
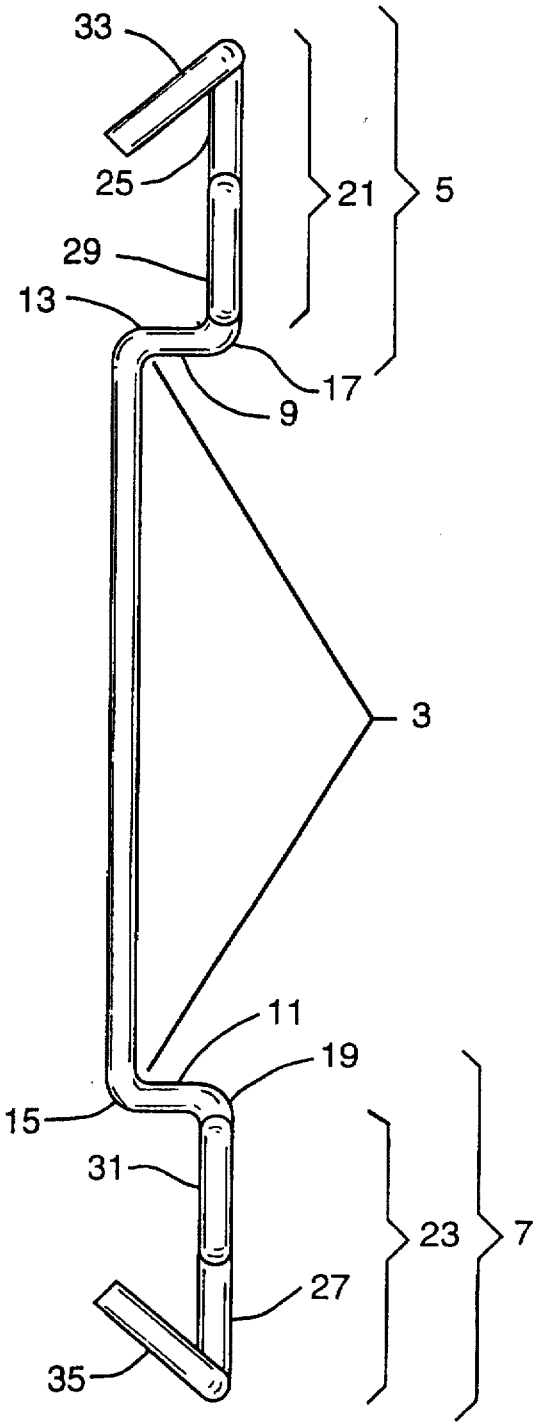
FIG. 2 is a left side view of a form of the apparatus of the combination of the present invention.
Figure 3:
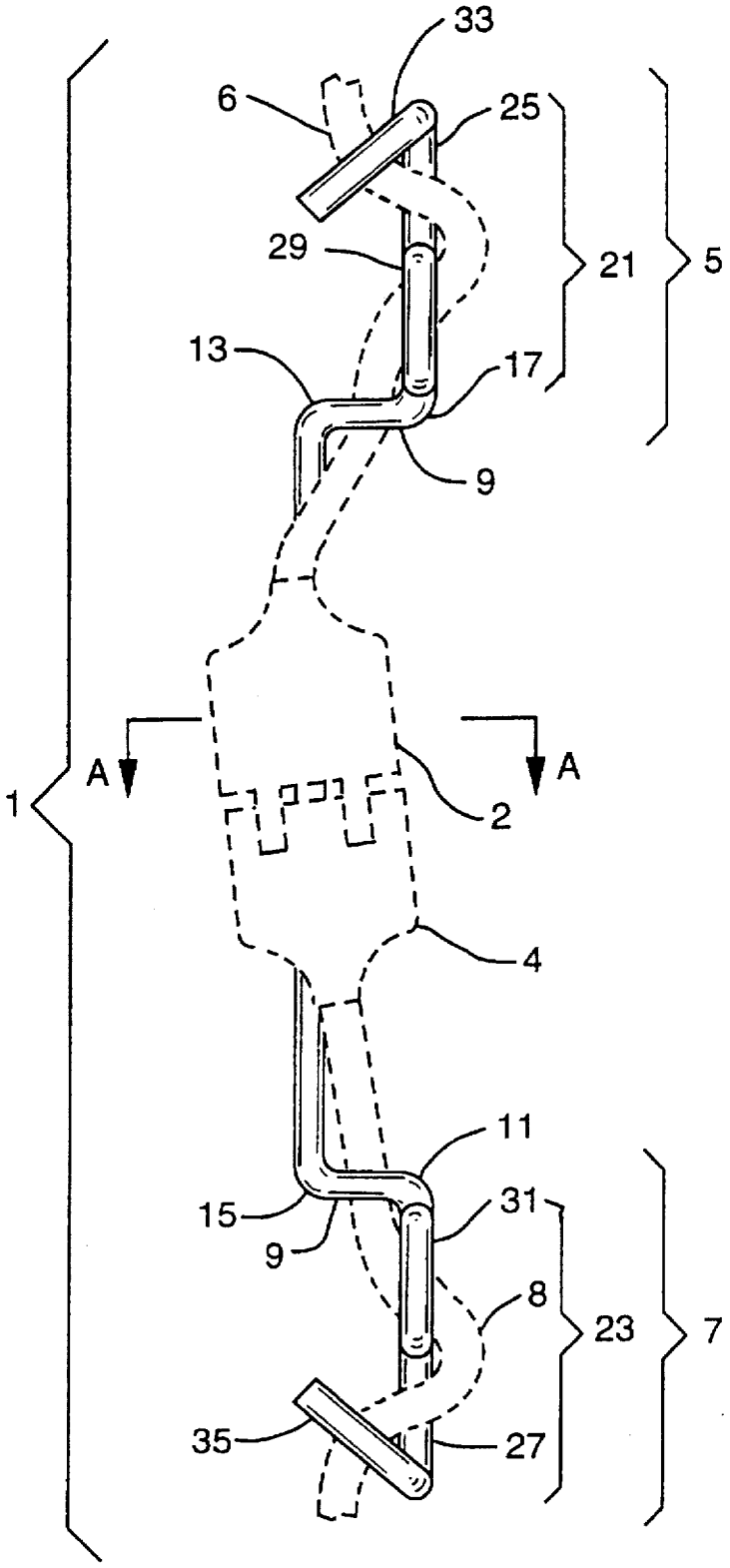
FIG. 3 is a left side view of a form of the combination of the present invention with a male connector electrical contacting device and a portion of the first electrical cable and the female connector electrical contacting device and a portion of the second electrical cable shown in broken lines, and the apparatus.

FIGS. 1–4 illustrate various views of a form of the combination, as described herein, of the present invention. In FIGS. 1–4, the apparatus of the combination of the present invention is shown, wherein the apparatus comprises a rigid body 1 having a center region 3, a first end region 5 and a second end region 7. The first end region 5 and the second end region 7 are at opposite ends of the center region 3 of the rigid body 1. The first end region 5 and the second end region 7 each define (a) a leg 9 and 11 having a proximal end 13 and 15 and a distal end 17 and 19 relative to the center region 3, wherein the proximal end 13 and 15 of each leg 9 and 11, respectively, forms about a ninety degree turn relative to the center region 3, and (b) a substantially S shaped structure 21 and 23. The S shaped structure 21 Of the first end region 5 has a middle section 25, and a proximal hook section 29 and a distal hook section 33 relative to the center region 3 of the rigid body 1. The S shaped structure 23 of the second end region 7 has a middle section 27, and a proximal hook section 31 and a distal hook section 35 relative to the center region 3 of the rigid body 1. FIGS. 1–3 show that the middle sections 25 and 27, respectively, are disposed between the proximal hook sections 29 and 31, respectively, and the distal hook sections 33 and 35, respectively. FIG. 1 shows that the proximal hook sections 29 and 31, respectively, face in opposite direction relative to the distal hook sections 33 and 35, respectively. FIGS. 1–3 show that the S shaped structure 21 of the first end region 5 defines a single turn and that the S shaped structure 23 of the second end region 7 defines a single turn. FIGS. 1–3 show that the distal ends 17 and 19 of the legs 11 and 9, respectively, form about a ninety degree turn relative to the proximal hook sections 29 and 31 of the S shaped structures 21 and 23, respectively. FIG. 1 shows that the center region 3 of the rigid body 1 and the legs 9 and 11 of the rigid body 1 are positioned with regard to the longitudinal axis of the center region 3, in a same longitudinal plane as the center region 3 of the rigid body 1. FIGS. 1–3 show that the proximal hook sections 29 and 31 and the middle sections 25 and 27 of the S shaped structures 21 and 23, respectively, are positioned in an outward extending direction in relationship to the legs 11 and 9, respectively, and the center region 3 of the rigid body 1 in such a manner that the proximal hook sections 29 and 31 and the middle sections 25 and 27 of the S shaped structures 21 and 23, respectively, lie outside the longitudinal plane of the center region 3. FIGS. 1–3 show that the S shaped structures 21 and 23 are positioned, relative to each other, with regard to the longitudinal axis of the center region 3 of the rigid body 1, on the same side in relationship to the longitudinal plane of the center region 3.

FIGS. 2–3 show the apparatus of the combination of the instant invention wherein the legs 9 and 11 are substantially in a perpendicular arrangement with regard to the center region 3 of the rigid body 1.

FIGS. 2–3 show the apparatus of the combination of the instant invention wherein the proximal hook sections 29 and 31 of the S shaped structures 21 and 23, respectively, are in a substantially perpendicular arrangement with regard to the distal ends 17 and 19, respectively, of the legs 11 and 9, respectively, of the rigid body 1.

It will be understood by those skilled in the art that the term "ninety degree turn" as used herein means a radius of curvature of about ninety degrees.

It will be appreciated by those skilled in the art that the rigid body 1 of the apparatus of the combination of the present invention as described herein is generally a solid bar. It is preferable that the solid bar is round or circular, however, it will be understood that the solid bar may be various shapes, for example oval or elliptical. It is also preferable that the solid bar be free of sharp or jagged edges and that each end of each distal hook sections 33 and 35 be smooth and may include for example a beveled end. Further it will be understood by those skilled in the art that the length and/or diameter of the rigid body 1 or solid bar of the apparatus of the combination of the present invention may be varied to accommodate various sizes, lengths and/or thicknesses of electrical connector contacting devices and/or electrical cables. Further it will be appreciated that the apparatus of the present combination may be made of such as for example but not limited to a metal or aluminum, or a polymer(s) such as for example but not limited to poly(vinyl chloride) capable of being formed to establish a rigid body.

FIG. 3 shows an embodiment of the combination of this invention wherein a male connector electrical contacting device 2 having a first electrical cable 6, shown in broken lines, and a female electrical contacting device 4 having a second electrical cable 8, also shown in broken lines, are (a) disposed in juxtaposition to the center region 3 of the rigid body 1 of the apparatus, and (b) capable of being intentionally manually engaged and disengaged adjacent to the center region 3 of the rigid body 1. FIG. 3 shows that the first electrical cable 6 is placed removably in the S shaped structure 21 of the first end region 5 of the rigid body 1 of the apparatus such that the first electrical cable 6 is wound through the S shaped structure 21 of the first end region 5. Further, FIG. 3 shows that the second electrical cable 8 is placed removably in the S shaped structure 23 of the second end region 7 of the rigid body 1 of the apparatus such that the second electrical cable 8 is wound through the S shaped structure 23 of the second end region 7.

In a more preferred embodiment of the present invention, FIG. 3 shows that the first electrical cable 6 passes (a) over proximal hook section 29, (b) under middle section 25, and (c) over distal hook section 33, of the S shaped structure 21, and that the second electrical cable 8 passes (a) over proximal hook section 31, (b) under middle section 27, and (c) over distal hook section 35, of the S shaped structure 23.

Figure 4:
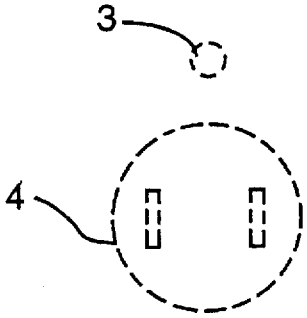
FIG. 4 is a cross-sectional view of the combination of the present invention of FIG. 3 taken along line A—A.

In a most preferred embodiment of the present invention, the combination, as described herein, further includes wherein the male connector electrical contacting device 2 and the first electrical cable 6 and the female connector electrical contacting device 4 and the second electrical cable 8 traverse the center region 3 of the rigid body 1 as illustrated in FIG. 3. FIG. 4 shows a view of the combination of the present invention taken along line A—A in FIG. 3. FIG. 4 shows rigid body 1 and an example of a face of a female connector electrical contacting device 4.

In another embodiment of the present invention, the combination as described herein and as shown in FIG. 2 includes wherein a portion of the distal hook sections 33 and 35 of the S shaped structures 21 and 23, respectively, are positioned in relationship to the legs 11 and 9, respectively, and the center region 3 of the rigid body 1 in such a manner that the portion of the distal hook sections 33 and 35, respectively, lie in the same longitudinal plane as the legs 11 and 9, respectively, and the center region 3.

In another embodiment of this invention, the combination as described herein and as shown in FIGS. 2–3 includes wherein the proximal hook sections 29 and 31 of the S shaped structures 21 and 23, respectively, are positioned in relationship to the horizontal axis of the middle sections 25 and 27, respectively, of the S shaped structures 21 and 23, respectively, in such a manner that the proximal hook sections 29 and 31, respectively, lie in a same horizontal plane as he middle sections 25 and 27, respectively.

In a further embodiment of this invention, the combination as described herein and as shown in FIGS. 2–3 includes wherein a portion of distal hook sections 33 and 35 of the S shaped structures 21 and 23, respectively, are positioned in relationship to the proximal hook sections 29 and 31, respectively, and the middle sections 25 ad 27, respectively, of the S shaped structures 21 and 23, respectively, in such a manner that the portion of the distal hook sections 33 and 35, respectively, lie in the same horizontal plane as the middle sections 25 and 27, respectively, and the proximal hook sections 29 and 31, respectively.

It will be appreciated by those skilled in the art that the combination of the present invention advantageously provides for enabling the secure engagement of a male connector electrical contacting device having a first electrical cable to a female connector electrical contacting device having a second electrical cable. The combination of the present invention generally eliminates the undesired problem of accidental and/or unintentional disengagement of one electrical cable from another.

Whereas particular embodiments of the present invention have been described herein for purpose of illustration, it will be evident to those skilled in the art that numerous variations of the details of the present invention may be made without departing from the invention as defined in the appended claims.

What is claimed is:

1. A combination of a male connector electrical contacting device, a female connector electrical contacting device, and an apparatus for securing the engagement of a first electrical cable of said male connector electrical contacting device to a second electrical cable of said female connector electrical contacting device, said apparatus comprising:

a rigid body having a center region, a first end region and a second end region wherein said first region and said second end region are at opposite ends of said center region of said rigid body, said first end region and said second end region each defining (a) a leg having a proximal end and a distal end relative to said center region, wherein said proximal end of said leg forms about a ninety degree turn relative to said center region and (b) a substantially S shaped structure having a middle section and a proximal hook section and a distal hook section relative to said leg of said rigid body, said middle section of said S shaped structure disposed between said proximal hook section and said distal hook section of said S shaped structure, and wherein said proximal hook section of said S shaped structure faces in an opposite direction relative to said distal hook section of said S shaped structure, and wherein said distal end of said leg forms about a ninety degree turn relative to said proximal hook section of said S shaped structure, and wherein said center region and said legs are positioned with regard to the longitudinal axis of said center region of said rigid body, in a same longitudinal plane as said center region of said rigid body, and wherein said proximal hook and middle sections of said S shaped structures are positioned in an outward extending direction in relationship to said legs and said center region of said rigid body in such a manner that said proximal hook sections and said middle sections of said S shaped structures lie outside said longitudinal plane, and wherein said S shaped structures are positioned on the same side of said longitudinal plane, and wherein said male connector electrical contacting device and said female connector electrical contacting device are (a) disposed in juxtaposition to said center region of said rigid body, and (b) capable of being intentionally manually engaged and disengaged adjacent to said center region of said rigid body, and wherein said first electrical cable is placed removably in said S shaped structure of said first end region of said rigid body such that said first electrical cable is wound therethrough, and wherein said second electrical cable is placed removably in said S shaped structure of said second end region of said rigid body such that said second electrical cable is wound therethrough.

2. The combination of claim 1 wherein said first electrical cable passes (a) over said proximal hook section of said S shaped structure of said first end region of said rigid body, (b) under said middle section of said S shaped structure of said first end region and (c) over said distal hook section of said S shaped structure of said first end region, and wherein said second electrical cable passes (a) over said proximal hook section of said S shaped structure of said second end region of said rigid body, (b) under said middle section of said S shaped structure of said second end region and (c) over said distal hook section of said S shaped structure of said second end region.

3. The combination of claim 1 wherein a portion of said distal hook sections of said S shaped structures is positioned in relationship to said legs and center region of said rigid body in such a manner that said portion of said distal hook sections of said S shaped structures lie in said same longitudinal plane as said legs and said center region of said rigid body.

4. The combination of claim 1 wherein said legs are in a perpendicular arrangement with regard to said center region of said rigid body.

5. A combination of a male connector electrical contacting device, a female connector electrical contacting device, and an apparatus for securing the engagement of a first electrical cable of said male connector electrical contacting device to a second electrical cable of said female connector electrical contacting device, said apparatus comprising:

a rigid body having a center region, a first end region and a second end region wherein said first end region and said second end region are at opposite ends of said center region of said rigid body, said first end region and said second end region each defining (a) a leg having a proximal end and a distal end relative to said center region, wherein said proximal end of said leg forms about a ninety degree turn relative to said center region and (b) a substantially S shaped structure having a middle section and a proximal hook section and a distal hook section relative to said leg of said rigid body, said middle section of said S shaped structure disposed between said proximal hook section and said distal hook section of said S shaped structure, and wherein said proximal hook section of said S shaped structure faces in an opposite direction relative to said distal hook section of said S shaped structure, and wherein said distal end of said leg forms about a ninety degree turn relative to said proximal hook section of said S shaped structure, and wherein said center region and said legs are positioned with regard to the longitudinal axis of said center region of said rigid body, in a same longitudinal plane as said center region of said rigid body, and wherein said proximal hook and middle sections of said S shaped structures are positioned in an outward extending direction in relationship to said legs and said center region of said rigid body in such a manner that said proximal hook sections and said middle sections of said S shaped structures lie outside said longitudinal plane, and wherein said S shaped structures are positioned on the same side of said longitudinal plane, and wherein said proximal hook sections of said S shaped structures are in a perpendicular arrangement with regard to said distal ends of said legs of said rigid body, and wherein said male connector electrical contacting device and said female connector electrical contacting device are (a) disposed in juxtaposition to said center region of said rigid body, and (b) capable of being intentionally manually engaged and disengaged adjacent to said center region of said rigid body, and wherein said first electrical cable is placed removably in said S shaped structure of said first end region of said rigid body such that said first electrical cable is wound therethrough, and wherein said second electrical cable is placed removably in said S shaped structure of said second end region of said rigid body such that said second electrical cable is wound therethrough.

6. The combination of claim 1 wherein said rigid body is generally a solid round bar.

7. A combination of a male connector electrical contacting device, a female connector electrical contacting device, and an apparatus for securing the engagement of a first electrical cable of said male connector electrical contacting device to a second electrical cable of said female connector electrical contacting device, said apparatus comprising:

a rigid body having a center region, a first end region and a second end region wherein said first end region and said second end region are at opposite ends of said center region of said rigid body, said first end region and said second end region each defining (a) a leg having a proximal end and a distal end relative to said center region, wherein said proximal end of said leg forms about a ninety degree turn relative to said center region and (b) a substantially S shaped structure having a middle section and a proximal hook section and a distal hook section relative to said leg of said rigid body, said middle section of said S shaped structure disposed between said proximal hook section and said distal hook section of said S shaped structure, and wherein said proximal hook section of said S shaped structure faces in an opposite direction relative to said distal hook section of said S shaped structure, and wherein said distal end of said leg forms about a ninety degree turn relative to said proximal hook section of said S shaped structure, and wherein said center region and said legs are positioned with regard to the longitudinal axis of said center region of said rigid body, in a same longitudinal plane as said center region of said rigid body, and herein said proximal hook and middle sections of said S shaped structures are positioned in an outward extending direction in relationship to said legs and said center region of said rigid body in such a manner that said proximal hook sections and said middle sections of said S shaped structures lie outside said longitudinal plane, and wherein said S shaped structures are positioned on the same side of said longitudinal plane, and wherein said proximal hook sections of said S shaped structures are positioned in relationship to the horizontal axis of said middle sections of said S shaped structures in such a manner that said proximal hook sections of said S shaped structures lie in a same horizontal plane as said middle sections of said S shaped structures, and wherein said male connector electrical contacting device and said female connector electrical contacting device are (a) disposed in juxtaposition to said center region of said rigid body, and (b) capable of being intentionally manually engaged and disengaged adjacent to said center region of said rigid body, and wherein said first electrical cable is placed removably in said S shaped structure of said first end region of said rigid body such that said first electrical cable is wound therethrough, and wherein said second electrical cable is placed removably in said S shaped structure of said second end region of said rigid body such that said second electrical cable is wound therethrough.

8. The combination of claim 7 wherein a portion of said distal hook sections of said S shaped structures are positioned in relationship to said proximal hook sections and middle sections of said S shaped structures in such a manner that said portion of said distal hook sections of said S shaped structures lie in the same horizontal plane as said middle sections and said proximal hook sections of said S shaped structures.

* * * * *